US011668176B2

(12) United States Patent
Chen et al.

(10) Patent No.: US 11,668,176 B2
(45) Date of Patent: Jun. 6, 2023

(54) WELL CONFIGURATION FOR COINJECTION

(71) Applicant: CONOCOPHILLIPS COMPANY, Houston, TX (US)

(72) Inventors: Bo Chen, Houston, TX (US); Qing Chen, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/481,530

(22) Filed: Sep. 22, 2021

(65) Prior Publication Data

US 2022/0074296 A1 Mar. 10, 2022

Related U.S. Application Data

(62) Division of application No. 15/673,809, filed on Aug. 10, 2017, now Pat. No. 11,156,072.

(60) Provisional application No. 62/379,613, filed on Aug. 25, 2016.

(51) Int. Cl.

| | |
|---|---|
| ***E21B 43/30*** | (2006.01) |
| ***E21B 43/24*** | (2006.01) |
| *E21B 43/16* | (2006.01) |

(52) U.S. Cl.

CPC ..... *E21B 43/305* (2013.01); *E21B 43/2408* (2013.01); *E21B 43/164* (2013.01); *E21B 43/168* (2013.01)

(58) Field of Classification Search

None

See application file for complete search history.

(56) References Cited

U.S. PATENT DOCUMENTS

| | | | | |
|---|---|---|---|---|
| 3,960,214 | A * | 6/1976 | Striegler | E21B 43/24 166/50 |
| 4,336,839 | A | 6/1982 | Wagner | |
| 4,662,441 | A * | 5/1987 | Huang | E21B 43/305 166/50 |
| 4,682,652 | A * | 7/1987 | Huang | E21B 43/24 166/50 |
| 6,230,814 | B1 | 5/2001 | Nasr et al. | |
| 6,591,908 | B2 | 7/2003 | Nasr | |
| 7,780,152 | B2 | 8/2010 | Rao | |
| 7,814,867 | B2 | 10/2010 | Petzer-Zilevitch | |
| 8,079,417 | B2 | 12/2011 | Wegener | |
| 8,353,342 | B2 | 1/2013 | Latimer et al. | |
| 8,353,343 | B2 | 1/2013 | Seaba et al. | |

(Continued)

FOREIGN PATENT DOCUMENTS

CA 2665751 A1 11/2009

OTHER PUBLICATIONS

Gates, I. D. "Solvent-aided steam-assisted gravity drainage in thin oil sand reservoirs." J. Petrol. Sci. Engin. 74(3-4):138-146 (2010).

(Continued)

*Primary Examiner* — Anuradha Ahuja

(74) *Attorney, Agent, or Firm* — Boulware & Valoir

(57) ABSTRACT

A well configuration for co-injection processes, wherein a horizontal producer well at the bottom of the pay is combined with injection or injection and producer wells that are vertical and above the lower horizontal production well. This well arrangement minimizes "blanket" effects by non-condensable gases.

20 Claims, 16 Drawing Sheets

(56) References Cited

U.S. PATENT DOCUMENTS

| | | | | |
|---|---|---|---|---|
| 8,602,103 | B2 | 12/2013 | Lamont | |
| 8,656,999 | B2 | 2/2014 | Latimer et al. | |
| 2008/0135241 | A1* | 6/2008 | Iqbal | E21B 43/2406 166/57 |
| 2010/0050517 | A1 | 3/2010 | Tsilevich | |
| 2011/0036308 | A1 | 2/2011 | Petzer-Zilevitch | |
| 2011/0232545 | A1 | 9/2011 | Clements | |
| 2012/0073810 | A1 | 3/2012 | Macadam et al. | |
| 2012/0227964 | A1 | 9/2012 | Lamont | |
| 2013/0068458 | A1 | 3/2013 | Macadam et al. | |
| 2013/0333884 | A1 | 12/2013 | Ryan | |
| 2014/0060825 | A1 | 3/2014 | Macadam et al. | |
| 2014/0110109 | A1 | 4/2014 | Latimer et al. | |
| 2014/0231081 | A1 | 8/2014 | Scinta et al. | |

OTHER PUBLICATIONS

Betzer-Zilevitch, M.; "Steamdrive direct contact steam generation for SAGD" CSUG/SPE 148698, Paper presented at Canadian Unconventional Resources Conference held in Calgary, Alberta, Canada (Nov. 2011).

Nasr, T. N.; Ayodele, O. R. New hydrid steam-solvent processes for the recovery of heavy oil and Bitumen. SPE 101717. Paper presented at Abu Dhabi Intnl. Petroleum Exhibition and Conf. in Abu Dhabi, U.A.E. (Nov. 2006).

* cited by examiner

WELL CONFIGURATION FOR COINJECTION

PRIOR RELATED APPLICATIONS

This application is a divisional application of Ser. No. 15/673,809, filed Aug. 10, 2017 which claims priority of non-provisional application which claims benefit under 35 USC § 119(e) to U.S. Provisional Application Ser. No. 62/379,613 filed Aug. 25, 2016, entitled "Well Configuration for Coinjection," which is incorporated herein in its entirety.

FIELD OF THE DISCLOSURE

The disclosure generally relates to methods of improved oil and gas recovery and specifically to well configurations that are useful in co-injection strategies.

BACKGROUND OF THE DISCLOSURE

Canada and Venezuela have some of the largest deposits of a heavy oil called bitumen. Unfortunately, the bitumen is especially difficult to recover because it is wrapped around sand and clay, forming what is call 'oil sands.' Furthermore, the crude bitumen contained in the Canadian oil sands is a thick, sticky form of crude oil, so heavy and viscous (thick) that it will not flow unless heated or diluted with lighter hydrocarbons.

Conventional approaches to recovering heavy oils such as bitumen often focus on lowering the viscosity through the addition of heat and/or solvents. Commonly used in-situ thermal recovery techniques include a number of reservoir heating methods, such as steam flooding, cyclic steam stimulation, and the very popular "Steam Assisted Gravity Drainage" or "SAGD."

In a typical SAGD process, shown in FIG. 1, two horizontal wells are vertically spaced by 4 to less than 10 meters (m). The production well is located near the bottom of the pay and the steam injection well is located directly above and parallel to the production well. In SAGD, steam is injected continuously into the injection well, where it rises in the reservoir and forms a steam chamber.

With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within the steam chamber.

The conventional horizontal wellpair configuration, where an injector is placed about 5 meters over a producer at the bottom of the reservoir is quite successful in SAGD projects. Due to the high cost and large water consumption of steam generation, however, extensive efforts, both in industry and academics, have been focused on innovative technologies to reduce SOR (steam-oil ratio—an important economic indicator for SAGD) of a SAGD project.

Typically the steam for SAGD is produced at a central processing facility and then piped to the wellpad for injection and this contributes significant cost to the method, which uses very large amounts of steam. Indeed, as many as 7 barrels of water is co-produced per barrel of oil.

Direct steam generators ("DSGs") can be used at the wellpad, where fuel is burned with oxygen in the presence of water to produce combined steam and $CO_2$ for injection. However, with the traditional SAGD well configuration of two horizontal wells, the non-condensable gas (NCG) behavior of $CO_2$ results in gas accumulation at the steam chamber front, or so called "blanket effect," that acts as an insulative layer, retarding the development of the steam chamber and therefore heavy oil recovery. Thus, DSG use has not been as widely employed as it might otherwise be due to the blanket effects of the $CO_2$.

Vapor Extraction (VAPEX) is a relatively new process that can also be used to extract heavy oil from deep oil reservoirs. It is similar to the process of SAGD, but instead of injecting hot steam into the oil reservoir, hydrocarbon solvents are used. A typical VAPEX process is shown in FIG. 2. Instead of steam, a solvent gas, or a mixture of solvents, such as ethane, propane and butane is injected along with a carrier gas such as $N_2$ or $CO_2$. Solvent selection is based upon the reservoir pressure and temperature. The solvent gas is injected at its dew point. The carrier gas is intended to raise the dew point of the solvent vapor so that it remains in the vapor phase at the reservoir pressure. A vapor chamber is formed and it propagates laterally. The main mechanism of oil mobilization is viscosity reduction.

The process relies on molecular diffusion and mechanical dispersion for the transfer of solvent to the bitumen for viscosity reduction. Dispersion and diffusion are inherently slow, and therefore, are much less efficient than heat for viscosity reduction. However, the process uses much less heat and water than SAGD, although solvent costs are likely to be even higher than steam costs, making the method less practical unless most of the solvent can be captured and recycled.

Another developing enhanced oil recovery technique combines aspects of both SAGD and VAPEX. In expanding solvent-SAGD or ES-SAGD, also known as solvent assisted process (SAP) or solvent co-injection (SCI), both steam and solvent are co-injected into the well. During the ES-SAGD process a small amount of solvent with boiling temperature close to the steam temperature is co-injected with steam in a vapor phase in a gravity process similar to the SAGD process. Suitable solvents are butane, naphtha, diluent and other light hydrocarbons. Typically the injected solvent comprises 5-25 percent of the injected steam.

The solvent condenses with steam at the boundary of the steam chamber. The condensed solvent dilutes the oil and reduces its viscosity in conjunction with heat from the condensed steam. This process offers higher oil production rates and recovery with less energy and water consumption than those for the SAGD process, and less solvent usage than VAPEX. Experiments conducted with two-dimensional models for Cold Lake-type live oil showed improved oil recovery and rate, enhanced non-condensable gas production, lower residual oil saturation, and faster lateral advancement of heated zones (Nasr and Ayodele, 2006). A solvent assisted SAGD is shown in FIG. 3 and is described in U.S. Pat. Nos. 6,230,814 and 6,591,908.

It is proposed that as the solvent condenses, the viscosity of the hydrocarbons at the steam-hydrocarbon interface decreases. As the steam front advances, further heating the reservoir, the condensed solvent evaporates, and the condensation-evaporation mechanism provides an additional driving force due to the expanded volume of the solvent as a result of the phase change. It is further believed that the combination of reduced viscosity and the condensation-evaporation driving force increase mobility of the hydrocarbons to the producing well.

Combining solvent dilution and steam heat reduces oil viscosity much more effectively than using heat alone, uses less water and produces fewer overall greenhouse gas emissions. See e.g., FIGS. 4 A and B.

One of the difficulties, however, with ES-SAGD or any combined steam and solvent co-injections is getting the ratio of solvent to steam correct. Too little solvent results in less solvent dissolution in the oil and thus less viscosity reduction. However, too much solvent can lead to excessive solvent in gaseous phase that forms an insulation blanket near steam chamber interface, thus preventing effective heat transfer.

Thus, there exist a need for reducing and/or mitigating the gas blanket issue, and fully realizing the power of co-injection techniques. If the gas blanket issue could be addressed, then direct steam generation could be used allowing for more cost effective steam generation.

SUMMARY OF THE DISCLOSURE

The present disclosure is generally directed to improved well configurations that can be used in steam-solvent co-injection enhanced oil recovery techniques and avoids the problem of a gas blanket insulating the steam chamber and reducing heat transfer to the heavy oil.

This invention proposes a new well configuration that combines vertical and horizontal wells in solvent-steam co-injection processes for e.g., Athabasca oil sand recovery projects and similar reservoirs. The invention is particularly suitable for direct steam generation production of steam, which results in $CO_2$ and steam being co-injected into the reservoir.

In DSG the heat is transferred between the combustion gases and the liquid water through the direct mixing of the two flows. The combustion pressure is similar to the produced steam pressure and the combustion gases are mixed with the steam so that both are injected into the reservoir. The DSG can also be referred to as direct contact evaporator or direct contact dryer. Depending on the system used, Low Pressure (LP), Medium Pressure (MP), or High Pressure (HP) steam can be produced. There are a large variety of DSGs available, including rotating DSGs (U.S. Pat. No. 7,814,867), up-flow fluid bed combustion DSGs (CA2665751), down flow combustion DSGs (US20100050517), and integrated rotating DSGs (US20110036308), high pressure SDSGs (US20110232545), vortex flow DSGs (U.S. Pat. No. 7,780,152), and well as downhole DSGs (U.S. Pat. No. 4,336,839) and the like.

In this application of DSG, the outlet stream of a mixture of $CO_2$ and steam, which is generated through a direct combustion of e.g., natural gas and oxygen in the presence of water, is injected directly into reservoirs. The co-injected $CO_2$ plays the role of both solvent and non-condensable gas (NCG) during the bitumen recovery process. With the traditional SAGD well configuration of two horizontal wells, the NCG behavior of $CO_2$ results in gas accumulation at the steam chamber front, or so called "blanket effect" that retards the development of the steam chamber and therefore bitumen recovery.

The proposed well configuration in contrast consists of a horizontal producer that is placed at the bottom of the reservoir, and vertical injectors and producers that are alternatively located several meters above and along the horizontal producer. This new well configuration also works for the applications of C02-steam or NCG-steam co-injection processes.

For DSG/$CO_2$-Steam/NCG-Steam co-injection applications, this new well configuration has several advantages over the traditional SAGD well configuration as follows:

In the early stage right after the preheating period, the gravity drive together with the horizontal gas drive quickly boosts oil rates;

A gas transport channel is created after the first several months of production. It transports the NCG (mainly $CO_2$ for DSG outlet steam) towards the vertical producer nearby, efficiently minimizing NCG accumulation ahead of the steam front and thus improving heat transfer into the cold bitumen.

The combination of vertical and horizontal wells provides more freedom to design and optimize the recovery process in different production stages, such as switching injection and production of the vertical wells, injecting stream compositions through different depths of the vertical injectors, producing NCG from different depths of the vertical producer, taking advantage of gas drive after steam chambers coalescence, etc.

The invention thus includes any one or more of the following embodiments, in any combination(s) thereof:

A well configuration for producing heavy oil, said configuration including a horizontal production well near a bottom of a heavy oil payzone, and a plurality of alternating vertical injector wells and vertical producer wells along said horizontal production well and terminating above said horizontal production well.

A well configuration as described herein, wherein said alternating vertical injector wells and vertical producer wells terminate 4-25 meters (m) above said horizontal production well.

A well configuration as described herein, wherein said alternating vertical injector wells and vertical producer wells terminate 5-10 m above said horizontal production well.

A well configuration as described herein, wherein an array of a horizontal production wells near the bottom of a heavy oil payzone each have a plurality of alternating vertical injector wells and vertical producer wells along each said horizontal production well.

A well configuration as described herein, wherein a radial array of a horizontal production wells near the bottom of a heavy oil payzone each have a plurality of alternating vertical injector wells and vertical producer wells along each said horizontal production well.

A well configuration as described herein, wherein said horizontal production well near the bottom of a heavy oil payzone has a plurality of branches.

A well configuration as described herein, wherein said horizontal production well near the bottom of a heavy oil payzone has a plurality of branches, and each branch has a plurality of alternating vertical injector wells and vertical producer wells.

A well configuration as described herein, wherein verticals wells are spaced 50-500 m) apart.

A well configuration as described herein, wherein injectors and/or producer wells are completed with active or passive flow control devices, or the producers are so equipped.

A method of heavy oil production, said method comprising:

a. providing a horizontal production well near a bottom of a heavy oil payzone;

b. providing a plurality of vertical injector wells and vertical producer wells along said horizontal production well and terminating above said horizontal production well;

c. injecting steam into said injector wells and at least said vertical producer wells until fluid communication is established;

d. injecting steam and non-condensable solvent only into said injector wells to mobilize oil and simultaneously producing mobilized oil and condensed steam from said horizontal producer well and producing non-condensable solvent from said vertical producer wells.

A method as herein described, wherein steam and solvent are produced for step c) using a direct steam generator (DSG).

A method as herein described, wherein steam is injected at a first depth that is higher than a second depth at which non-condensable gas is produced.

A method as herein described, using any of the well configurations herein described.

A method as herein described, wherein more heavy oil is produced every day than a comparable method using only horizontal injector wells and horizontal producer wells.

A method as herein described, wherein a startup period is reduced as compared with a comparable method using only horizontal injector wells and horizontal producer wells.

A method as herein described, wherein produced non-condensable solvent is recycled for use in the method.

An improved method of heavy oil production using DSG, said method comprising injecting steam and solvent into a horizontal injection well and collecting mobilized heavy oil and water from a horizontal production well, the improvement comprising injecting steam and solvent into a plurality of vertical injection wells that terminate above a horizontal producer well, and collecting mobilized heavy oil and water from said horizontal production well, and collecting non-condensed solvent from a plurality of vertical production wells that terminate above said horizontal producer well, wherein more heavy oil is produced every day than a comparable method using only horizontal injector wells and horizontal producer wells.

An improved method of heavy oil production using DSG, said method comprising producing steam and $CO_2$ with a DSG, injecting steam and $CO_2$ into a horizontal injection well and collecting mobilized heavy oil and water from a horizontal production well, the improvement comprising producing steam and $CO_2$ with a DSG, injecting steam and $CO_2$ into a plurality of vertical injection wells that terminate above a horizontal producer well, and collecting mobilized heavy oil and water from said horizontal production well, and collecting $CO_2$ from a plurality of vertical production wells that terminate above said horizontal producer well.

As used herein, "bitumen" and "extra heavy oil" are used interchangeably, and refer to crudes having less than 10° API.

As used herein, "heavy oil" refers to crudes having less than 22° API. The term heavy oil thus includes bitumens, unless it is clear from the context otherwise.

By "horizontal production well", what is meant is a well that is roughly horizontal (>45° off a horizontal plane) where it is perforated for collection of mobilized heavy oil. Of course, it will have a vertical portion to reach the surface, but this zone is typically not perforated and does not collect oil.

[By "vertical" well, what is meant is a well that is roughly vertical (<45° off a vertical line).

By "injection well" what is meant is a well that is perforated, so that steam or solvent can be injected into the reservoir via said injection well. An injection well can easily be converted to a production well (and vice versa), by ceasing steam injection and commencing oil collection.

Thus, injection wells can be the same as production wells, or separate wells can be provided for injection purposes. It is common at the start-up phase for production wells to also be used for injection, and once fluid communication is established, switched over to production uses.

As used herein a "production stream" or "production fluid" or "produced heavy oil" or similar phrase means a crude hydrocarbon that has just been pumped from a reservoir and typically contains mainly heavy oil and/or bitumen and water, and may also contain additives such as solvents, foaming agents, and the like.

By "mobilized" oil, what is meant is that the oil viscosity has been reduced enough for the oil to be produced.

By "steam", we mean a hot water vapor, at least as provided to an injection well, although some steam will of course condense as the steam exits the injection well and encounters cooler rock, sand or oil. It will be understood by those skilled in the art that steam usually contains additional trace elements, gases other than water vapor, and/or other impurities. The temperature of steam can be in the range of about 150° C. to about 350° C. However, as will be appreciated by those skilled in the art, the temperature of the steam is dependent on the operating pressure, which may range from about 100 psi to about 2,000 psi (about 690 kPa to about 13.8 MPa).

In the case of either the single or multiple wellbore embodiments of the invention, if fluid communication is not already established, it must be established at some point in time between the producing wellbore and a region of the subterranean formation containing the hydrocarbon fluids affected by the injected fluid, such that heavy oils can be collected from the producing wells.

By "fluid communication" we mean that the mobility of either an injection fluid or hydrocarbon fluids in the subterranean formation, having some effective permeability, is sufficiently high so that such fluids can be produced at the producing wellbore under some predetermined operating pressure. Means for establishing fluid communication between injection and production wells includes any known in the art, including steam circulation, geomechanically altering the reservoir, RF or electrical heating, chemical heating by exothermic reaction, in situ combustion ("ISC"), solvent injection, hybrid or combination processes and the like.

By "start-up" what is meant is that period of time when most or all wells are being used for steam injection in order to establish fluid communication between the wells. Start-up typically requires 3-6 months in traditional SAGD. Start-up time may be reduced with the proposed well configuration due to the additional pressure gradient on top of gravity drive. Start-up may sometimes be referred to as a "preheating" phase.

By "providing" wellbores herein, we do not imply contemporaneous drilling. Therefore, either new wells can be drilled or existing wells can be used as is, or retrofitted as needed for the method.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| API | American Petroleum Institute |
| API gravity | To derive the API gravity from the density, the density is first measured using either the hydrometer, detailed in ASTM D1298 or with the oscillating U-tube method detailed in ASTM D4052. Direct measurement is detailed in ASTM D287. |
| bbl | barrel |
| Cp | Centipoise |
| CSOR | Cumulative steam/oil ratio |
| CSS | Cyclic Steam Stimulation |
| cSt Centistokes | Kinematic viscosity is expressed in centistokes |
| DSG | Direct Steam Generation |
| EOR | Enhanced oil recovery |
| ES-SAGD | Expanding solvent-SAGD |
| ISC | In situ combustion |
| NCG | Non-condensable gas |
| OOIP | Original oil In place |
| OTSG | Once-through steam generator |
| RF | Radio frequency |
| SAGD | Steam assisted gravity drainage |
| SAGP | Steam and gas push |
| SAP | Solvent assisted process or Solvent aided process |
| SCTR | Sector recovery |
| SF | Steam flooding |
| SF-SAGD | Steam flood SAGD |
| SOR | Steam-to-oil ratio |
| THAI | Toe to heal air injection |
| VAPEX | Vapor extraction |
| VH-DSG | Vertical-Horizontal DSG |
| XSAGD | Cross SAGD where producers and injectors are perpendicular and used in an array. |

BRIEF DESCRIPTION OF THE DRAWINGS

The application file contains at least one drawing executed in color. Copies of this patent application publication with color drawing(s) will be provided by the Office upon request and payment of the necessary fee.

DETAILED DESCRIPTION

Figure 1:
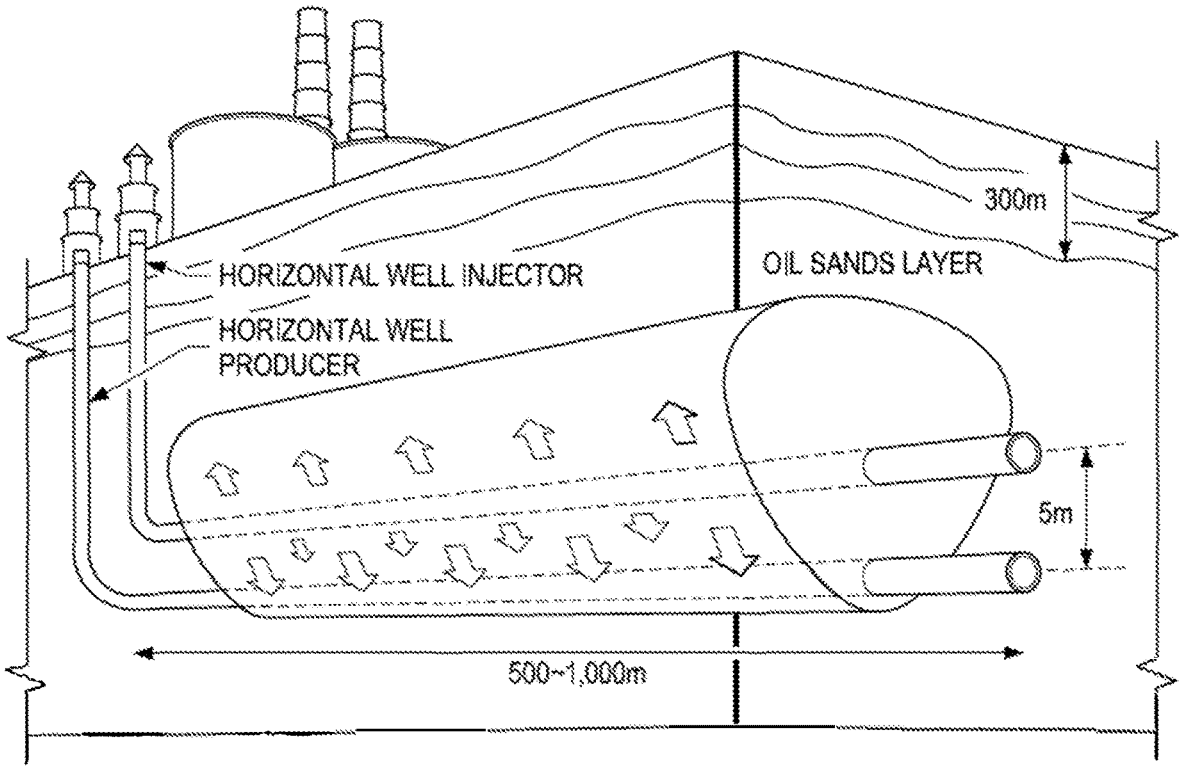
FIG. 1 (PRIOR ART)
FIG. 1 shows a conventional SAGD well pair.
Figure 2:
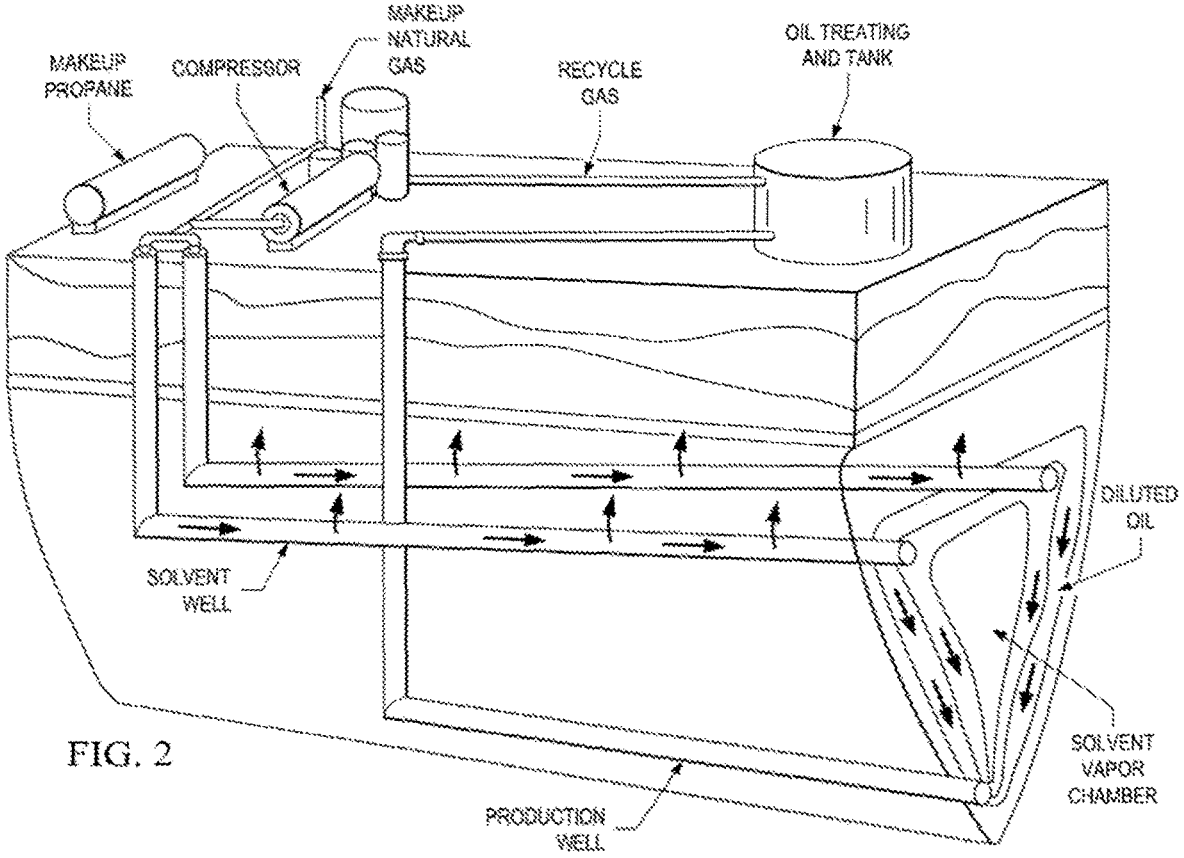
FIG. 2 shows a typical VAPEX process.
Figure 3:
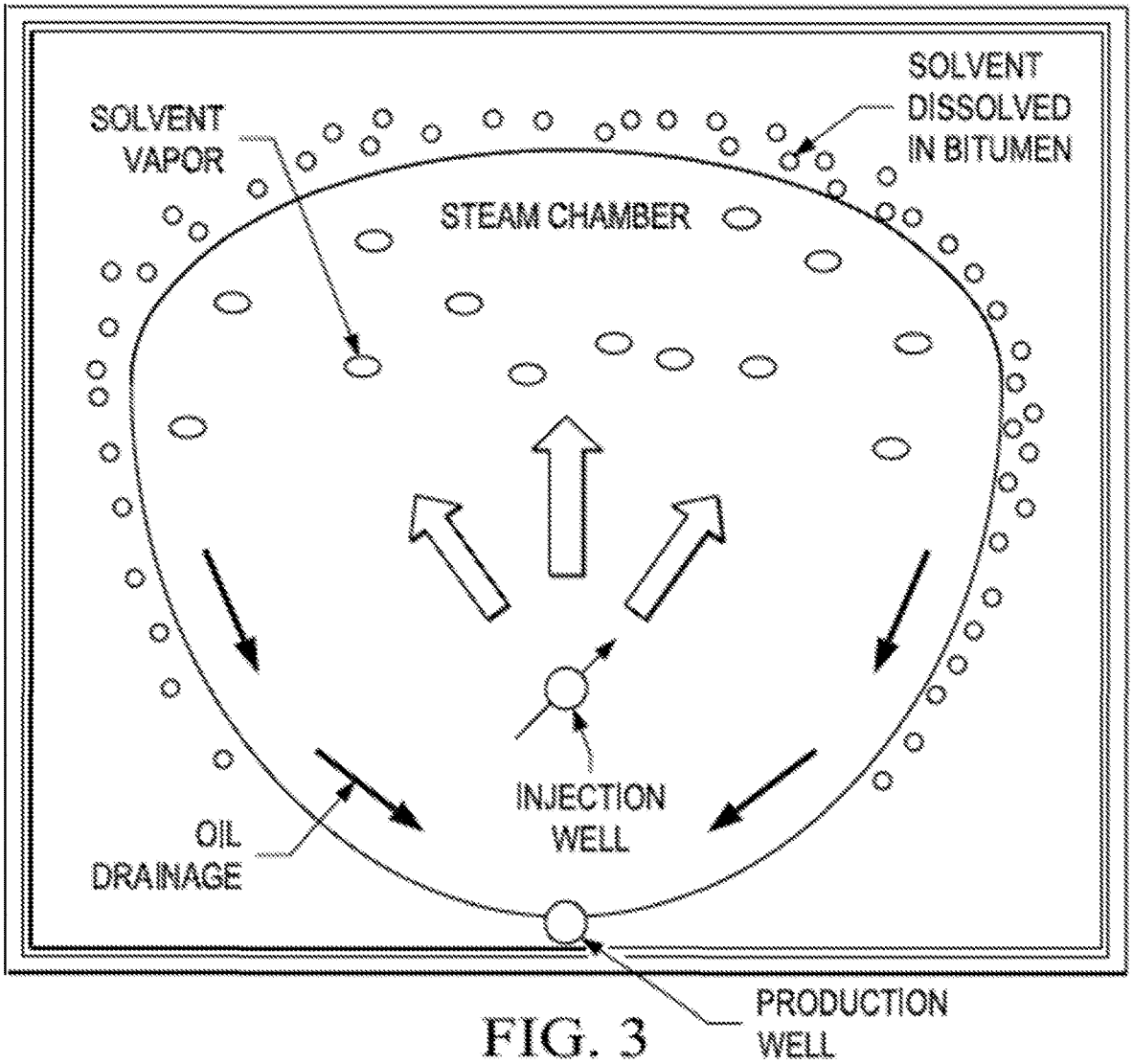
FIG. 3 shows an ES-SAGD process that can be used in the invention.
Figure 4A:
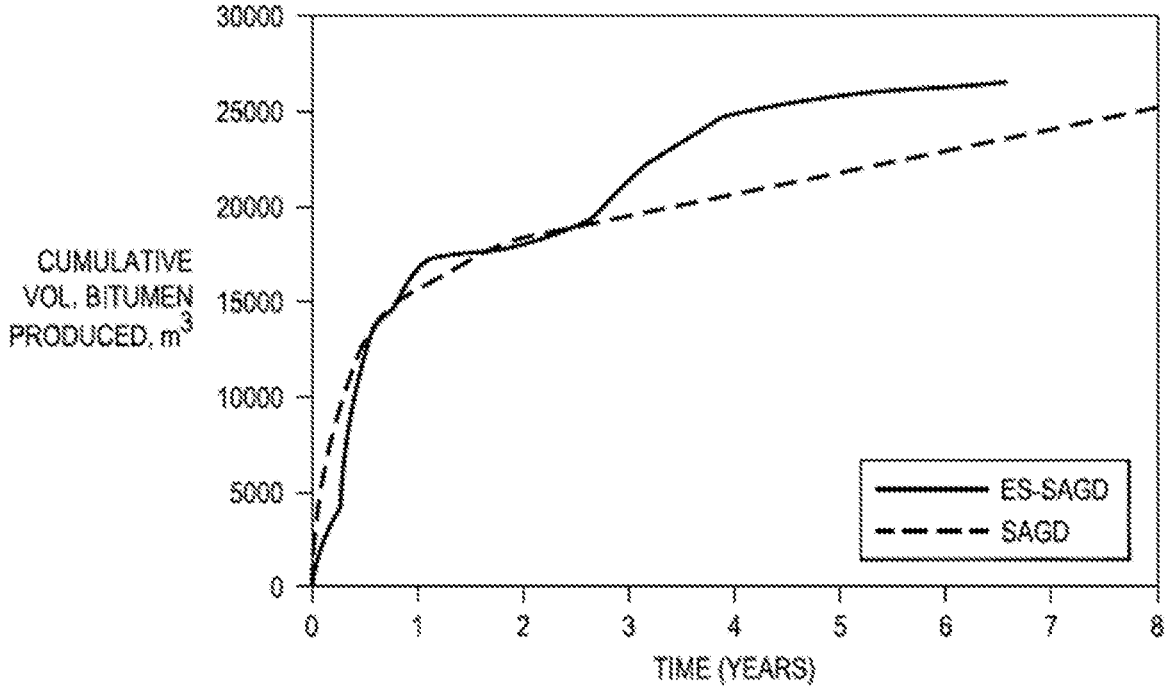
FIG. 4A shows cumulative bitumen production for SAGD versus ES-SAGD (from Gates 2010).
Figure 4B:
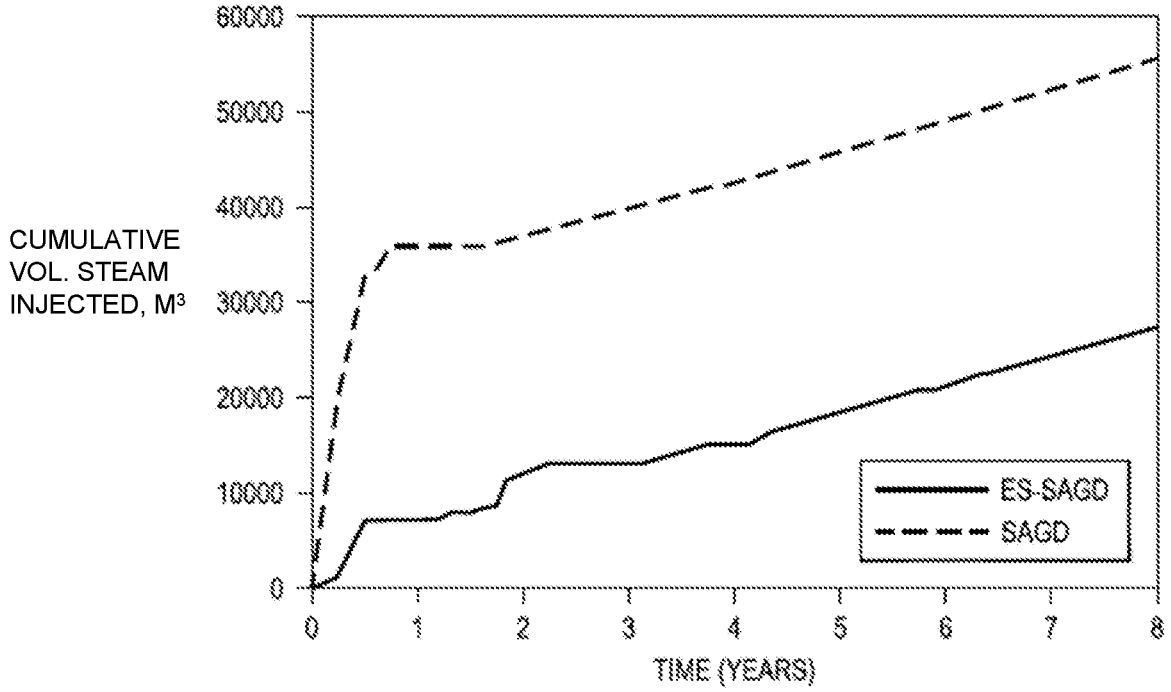
FIG. 4B shows cumulative steam usage, which is substantially decreased (from Gates 2010).

This disclosure relates to methods, systems and well configurations that avoid gas blanket problems and allow co-injection processes to be used more effectively, especially with DSG steam generation methods. Generally speaking the method uses horizontal production wells with vertical injectors and vertical producers to improve steam-solvent co-injection processes.

Any solvent-steam co-injection process or variant thereon can be used in the method, although we have exemplified herein the process using DSG generated steam-$CO_2$ co-injection.

In addition to $CO_2$, solvents used in steam-solvent co-injection processes can include non-condensable gases, light solvents, medium solvents, and combinations thereof. Solvents include at least $CH_4$, CO, $N_2$, $H_2$, ethane, propane, butane, pentane, hexane, up to C12, or more, flue gas, and the like. Inert gases have also been used for injection. Medium weight solvents (i.e., naphtha) gave the best results in the total oil production at a somewhat greater solvent loss, and light solvents and $CO_2$ are thus preferred.

Solvent to steam levels are typically about 5-20%, but since the solvent is being removed from the steam from via vertical producers, it may be possible to use higher amounts.

Nevertheless, the typical amount of $CO_2$ co-injected from a DSG will be a function of the efficiency of the generator, and is usually about 10% by mass, but can also vary with generator design and the fuel used. These factors will also affect the solvent profile of the co-injected solvents.

The novel well configurations were modeled using the commercial CMG® STARS reservoir modeling package. The simulation results show that the new well configuration significantly improves oil production at comparable CSOR over the control case of the traditional well configuration for DSG applications. It is also demonstrated in simulation that the proposed well configuration allows flexible injection/production designs and operation to optimize reservoir performance.

Direct steam generation based steam-$CO_2$ co-injection is a preferred method. DSG is an attractive steam generation technology and its advantages include significant reduction in facility footprint, higher energy efficiency of steam generation, reduction in water consumption (10% make-up water comes from combustion products), and being $CO_2$ capture ready.

Any DSG and co-injection process can be used herewith. U.S. Pat. No. 8,079,417, for example, relates to devices and methods for deploying steam generators and pumps in connection with steam injection operations. U.S. Pat. No. 8,353,342 relates to methods and systems that include both generating steam for injection into a wellbore and capturing $CO_2$ produced when generating the steam. U.S. Pat. No. 8,353,343 limits the amount of non-condensable gases in the mixture that may promote dissolving of the $CO_2$ into the hydrocarbons upon contact of the mixture with the hydrocarbons. U.S. Pat. No. 8,602,103 supplies water and then solvent for hydrocarbons in direct contact with combustion of fuel and oxidant to generate a stream suitable for injection into the reservoir in order to achieve thermal and solvent based recovery. U.S. Pat. No. 8,656,999 describes combustible water impurities in the water, which are then combusted inside a chamber in the direct steam generator and the solid particles are removed from the effluent stream to produce a treated stream. US20120073810 relates to recovery of in situ upgraded hydrocarbons by injecting steam and hydrogen into a reservoir containing the hydrocarbons. US20120227964 relates to methods and systems for processing flue gas from oxy-fuel combustion. US20130068458 relates to installation and configuration of heat exchanger on wellpads for SAGD production process, so as to recover heat from produced fluids at SAGD wellpads to preheat feedwater for wellpad steam generation. US20130333884 includes a $CO_2$ and steam co-injection well placed at a bottom of a reservoir some horizontal distance from a producer, such that the injection well and producer may both be in a common horizontal plane. US20140060825 provides methods and systems to generate steam and carbon dioxide mixtures suitable for injection to assist in recovering hydrocarbons from oil sands based on concentration of the carbon dioxide in the mixtures as influenced by temperature of water introduced into a direct steam generator. US20140110109 relates to systems and methods of generating steam from produced water by passing the produced water through first and second steam generators coupled together. US20140231081 describes systems and methods of recovering hydrocarbons by injecting into a reservoir outputs from two different types of steam generators along with carbon dioxide.

PRIOR ART WELL CONFIGURATION

The DSG device generates pressurized high temperature steam mixed with effluent gases (mainly $CO_2$, about 10 wt %) from the direct combustion of natural gas and oxygen in the presence of water, and the outlet stream of steam and effluent gases is injected directly into the reservoir. In DSG use with the conventional horizontal wellpair configuration (FIG. 1), a steam chamber forms and develops vertically and laterally, and mobilized bitumen drains along the chamber boundary under the gravity towards the production well in a manner similar to the SAGD process. The co-injected $CO_2$ helps reduce bitumen viscosity by dissolution of $CO_2$ into bitumen and mitigate heat loss to overburden by gas accumulation in the upper portion of the steam chamber.

The co-injected $CO_2$, however, also behaves as a NCG under the typical reservoir conditions (e.g., Surmont oil sands) and accumulates ahead of the steam front. This gas accumulation provides an insulating effect that retards the steam chamber development and slows bitumen recovery. Thus, the full benefits of DSG use cannot be realized due to the inhibiting effect of the gas blanket.

NOVEL WELL CONFIGURATION

To overcome the challenges of DSG applications with the conventional horizontal wellpair configuration, we propose herein a new well configuration that combines vertical wells and horizontal wells.

Our previous studies and field experiences indicate that NCG can trigger the gas drive mechanism in the region where bitumen is mobile and pressure gradient exists in between injectors and producers. A "gas drive" is similar to steam drive, used e.g., in steam flooding or cyclic stem stimulations, wherein the gas front pushes mobilized oil toward the producer.

It is also proven that the steam chamber development can be significantly improved by efficiently removing NCG from the steam chamber boundary as it travels to the vertically offset vertical producers, consequently resulting in a higher oil production rate.

In addition, it is believed that avoiding the "re-boiling" of $CO_2$ dissolved in bitumen when the oil phase of bitumen and $CO_2$ approaches the injector of high temperature keeps the benefit of the solvent effect of $CO_2$ that results in bitumen viscosity reduction.

The combination of vertical and horizontal well configuration for DSG applications can take advantage of each of these mechanisms.

Figure 5A:
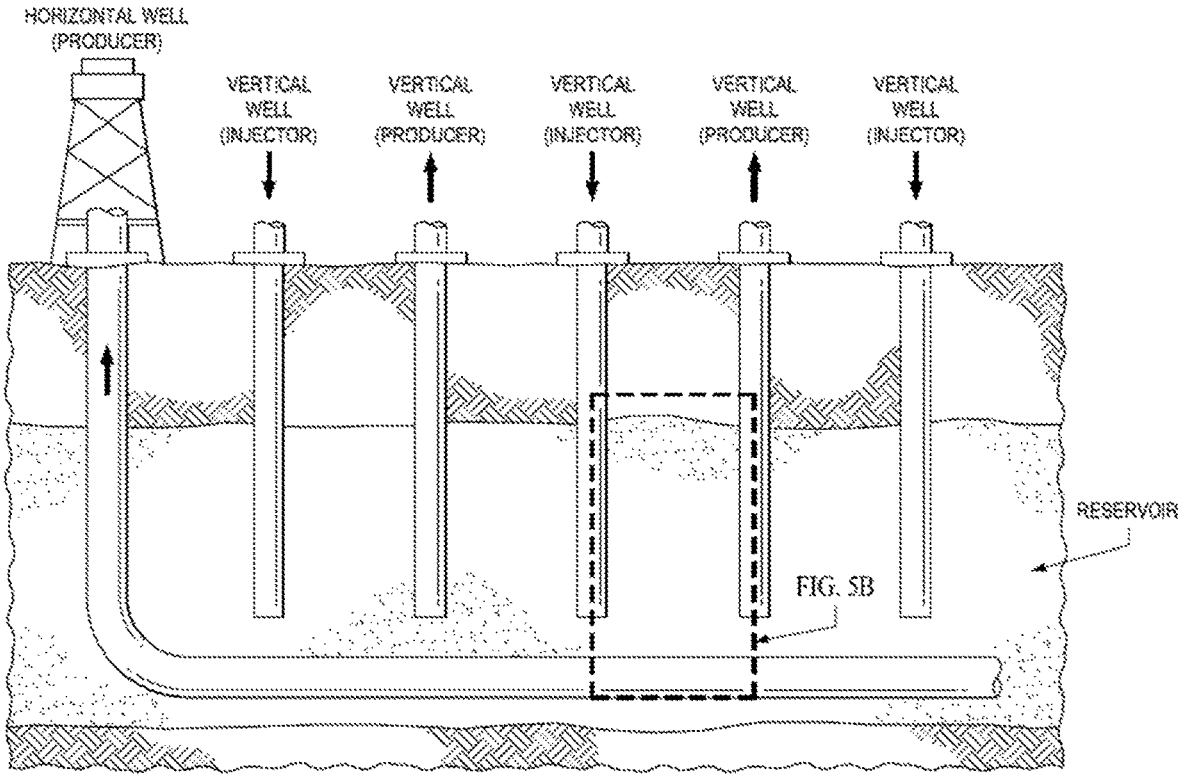
FIG. 5A depicts a side view of a horizontal producer with vertical injectors and producers.
Figure 5B:
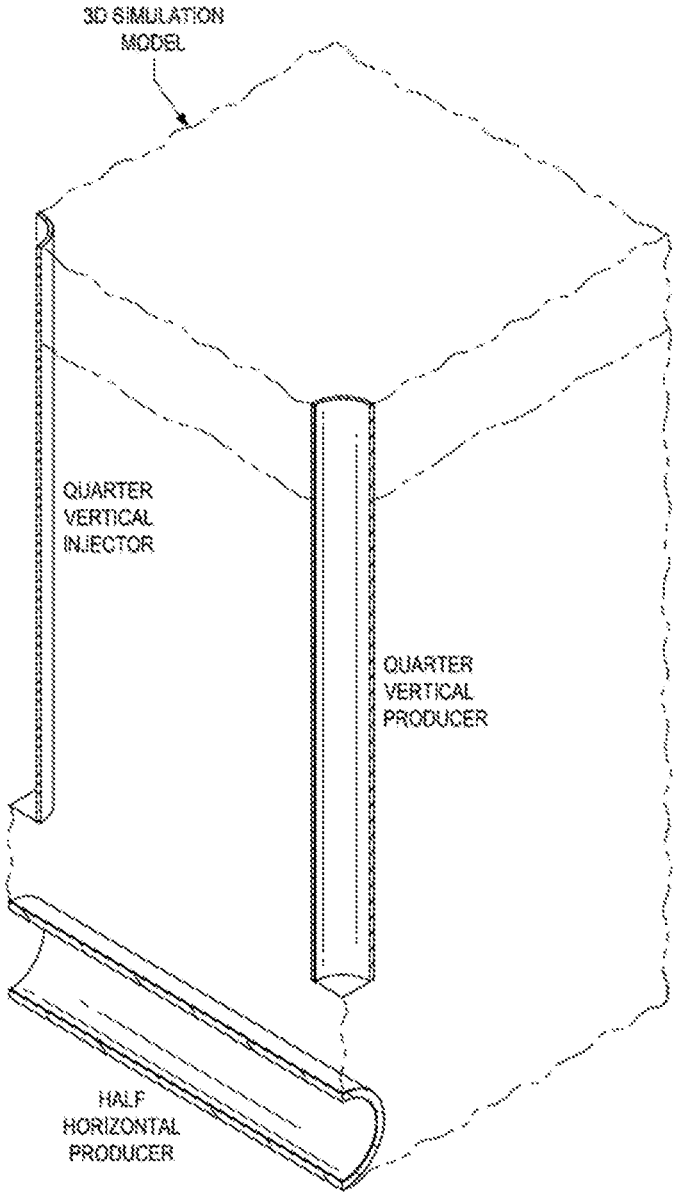
FIG. 5 B is a 3D simulation volume with a quarter vertical injector, quarter vertical producer and half a horizontal producer.

A general schematic of the proposed well configuration for DSG applications is shown in FIG. 5A & FIG. 5B. A horizontal producer with length of e.g., 1,000-3000 m or so is placed near the bottom of the payzone in the reservoir. A series of vertical injectors and producers are alternatively located several meters right above the horizontal producer, with a certain well spacing between neighboring vertical wells.

The vertical separation is preferably e.g., 4-25 meters, or 5-10 m, but more or less can be used depending on reservoir permeability, pressure and temperature characteristics. The horizontal separation between the vertical wells can also vary, but typically is e.g., 50-500 meters, or about 100 m, but more or less can be used depending on reservoir permeability, pressure and temperature characteristics, as well as on the overall pattern of wells in an array.

The DSG process starts with a "preheat" or "start-up" phase in which the DSG outlet stream of steam and $CO_2$ is circulated through the wellbores of all the wells to heat up the regions between wells by heat conduction. After establishing the thermal and fluid communication between wells, the DSG outlet stream is injected into the reservoir only through the vertical injectors, and a series of steam chambers form around the vertical injectors and expand continuously.

The horizontal well is operated under the steam trap control to produce oil and water that are driven by both gravity and pressure drive. The vertical producers function as a vent well to produce the NCG (mainly $CO_2$) with a minimum of live steam, and thus avoiding the gas accumulation in front of the steam chamber. The recovery process continues until the reservoir is depleted or an economic limit is reached.

SIMULATIONS

To evaluate the performance of the new well configuration for the DSG application, numerical simulations with a 3D homogeneous model were conducted using CMG® STARS.

Figure 10:
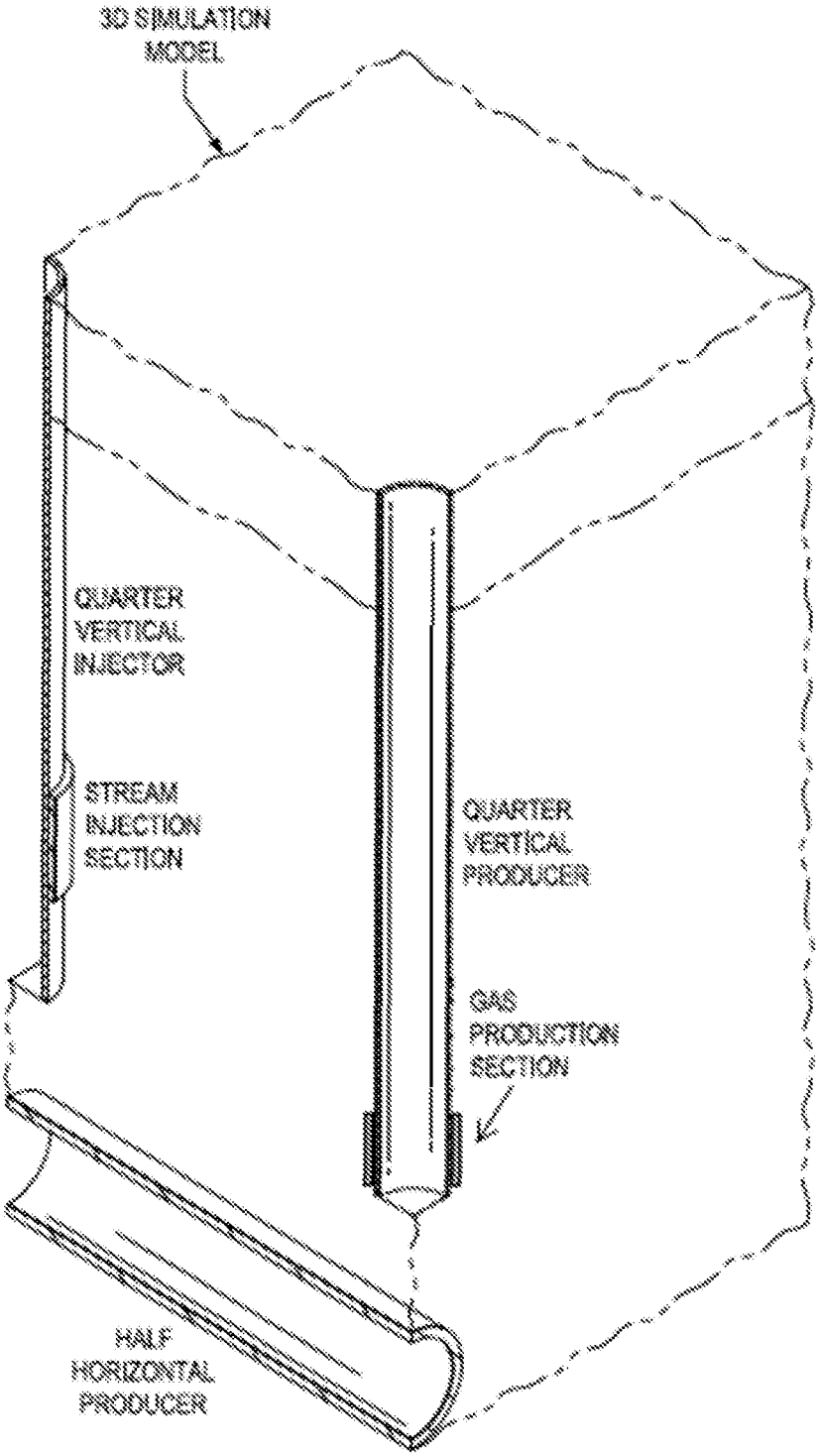
FIG. 10 shows a simulation model in CMG® STARS.

FIG. 10 shows the simulation model that represents a repeated pattern of a 60 m×60 m×35 m region by symmetry. The model consists of a half horizontal producer of 60 m in length located at the bottom, a quarter vertical injector and a quarter vertical producer with 2 m and 1 m, respectively, right above the horizontal producer. The Surmount average reservoir properties were used in the simulation.

Figure 9A:
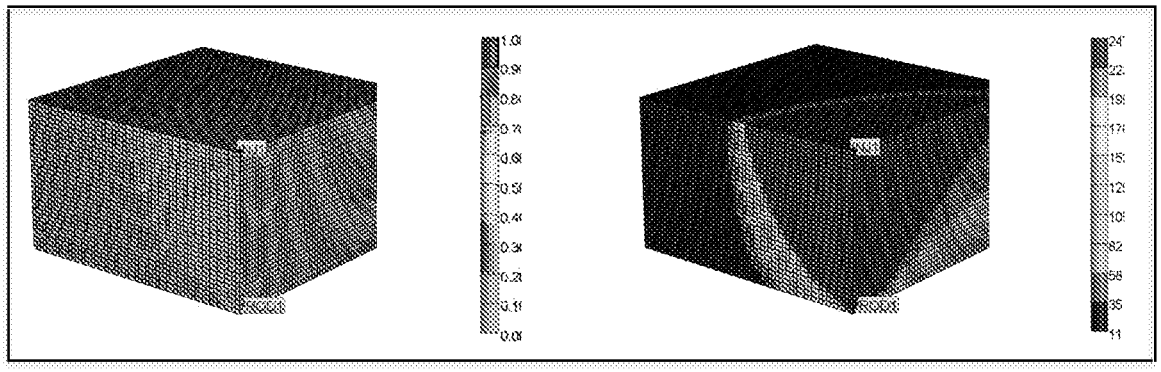
FIG. 9A (VH_DSG case) depicts performance of the DSG process with the new well configuration.
Figure 9B:
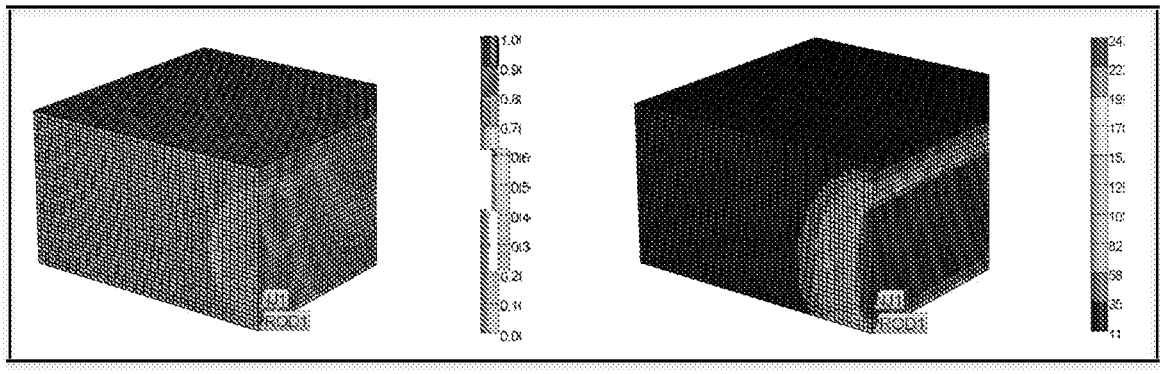
FIG. 9B (DSG control case) depicts performance of a conventional DSG process. VH_DSG case and DSG control case oil saturation (left) and temperature (C.°) (right) distributions depicted are after 3 years of simulated operation.

Two simulation cases were considered to compare the performance of the DSG process with the new well configuration (FIG. 9A) and with the conventional horizontal wellpair configuration (FIG. 9B). The simulation results of the two cases were compared in terms of oil production rate, CSOR (cumulative SOR), and oil recovery factor in FIG. 6, 7, FIG. 8, FIG. 9A & FIG. 9B, respectively. "VH_DSG" represents the combined Vertical-Horizontal DSG well configuration.

Figure 6:
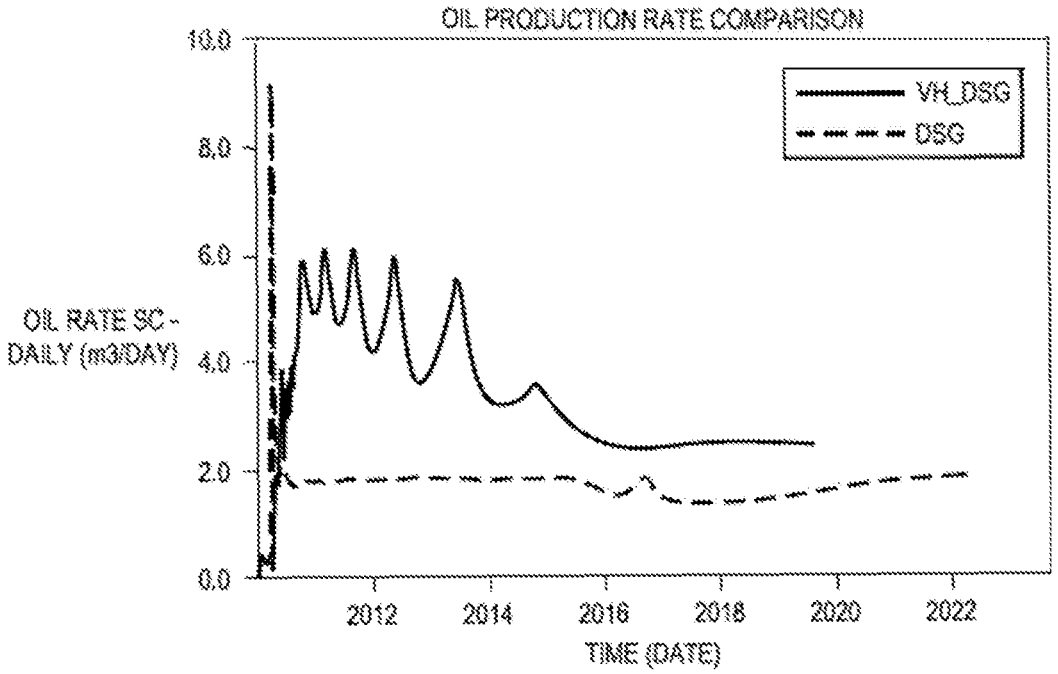
FIG. 6 shows an oil production rate comparison.
Figure 7:
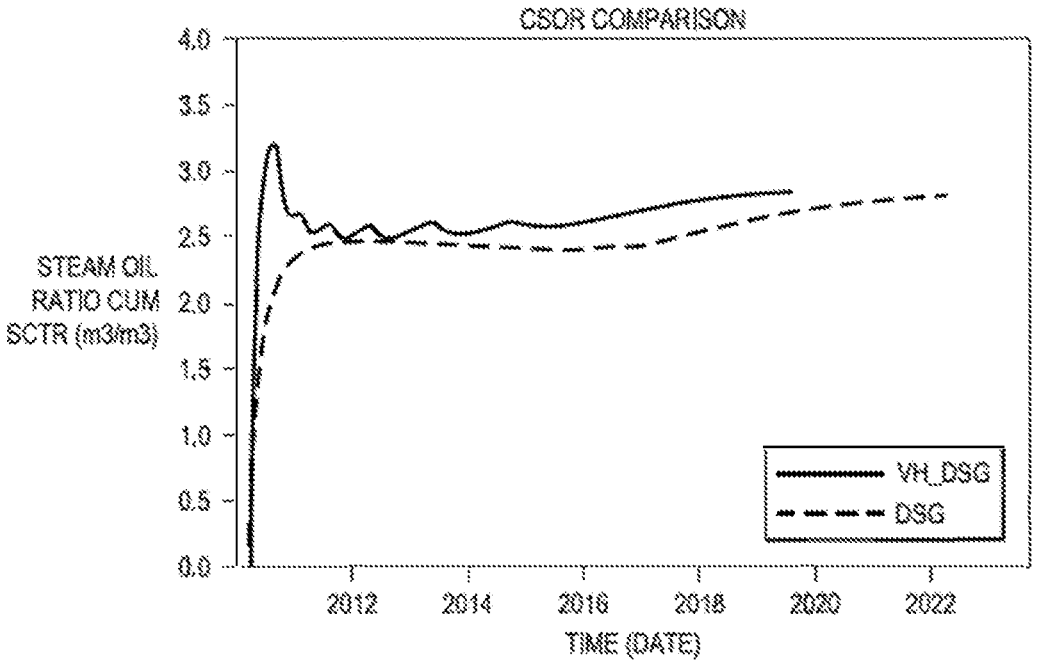
FIG. 7 shows a CSOR comparison.
Figure 8:
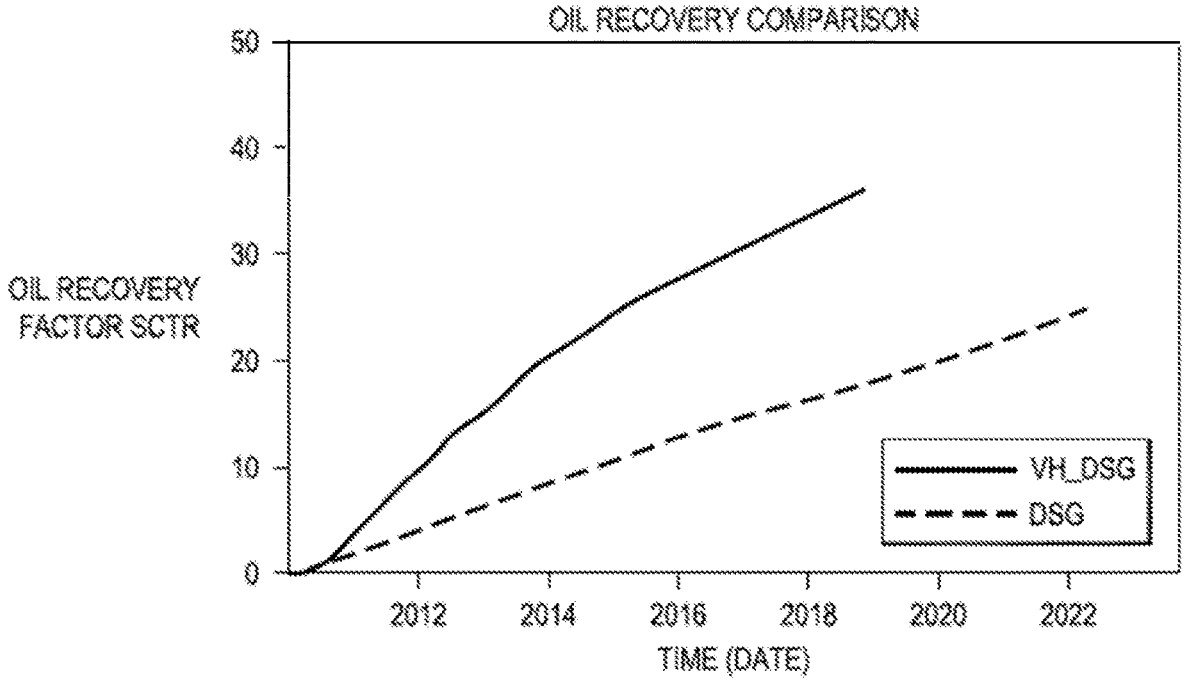
FIG. 8 shows an oil recovery comparison.

Note that the spikes of production in FIG. 6 etc. are mainly due to the well constraints (steam trap control) used in the simulation model to limit live steam production. If the production wells produce more live steam than the prescribed limit (usually 1 m<3>/day), the production wells will be choked back to limit the amount of steam rate in simulation. This results in the characteristics series of spikes.

The new well configuration case (VH_DSG) gave a higher oil production rate than the conventional well configuration case (DSG), while CSOR values of the two cases were comparable. The oil recovery in the VH_DSG case was doubled that of the DSG case for the same duration of operation.

FIG. 9 shows the profiles of temperature and the oil saturation after 3 years of simulated operation for both the VH_DSG and DSG cases. As seen in FIG. 9, the steam chamber develops much faster in the VH_DSG case than in the DSG case.

Another advantage of the proposed new well configuration is that it provides greater freedom in well design and operation for optimizing the performance of DSG applications. To illustrate this, a second case of VH_DSG (labeled as VH_DSG opt) was simulated, in which the vertical injection and production depths vary by inflow/outflow control devices.

In this simulation VH-DSG was compared against VH_DSG opt. The VH_DSG opt case otherwise utilizes the same well configuration as VH_DSG, but with active control devices, such as sliding sleeves or interval control valves or passive flow control devices. In the early stage, the steam or steam-gas was injected at lower segment of the vertical wells to accelerate the steam chamber development, while at the later stage, it was desired to inject through the upper segment of the vertical wells to increase gas push, but avoid steam breakthrough to the horizontal producer. For the vertical producer (vent well), opening the well at the lower portion of the well helps pulling the steam/thermal chamber toward to the horizontal producer and hence increasing thermal contact and oil drainage.

After simulated operation of half year, the stream was injected through a certain section of the vertical well and gas was produced at the certain section of the vertical producer.

Figure 11:
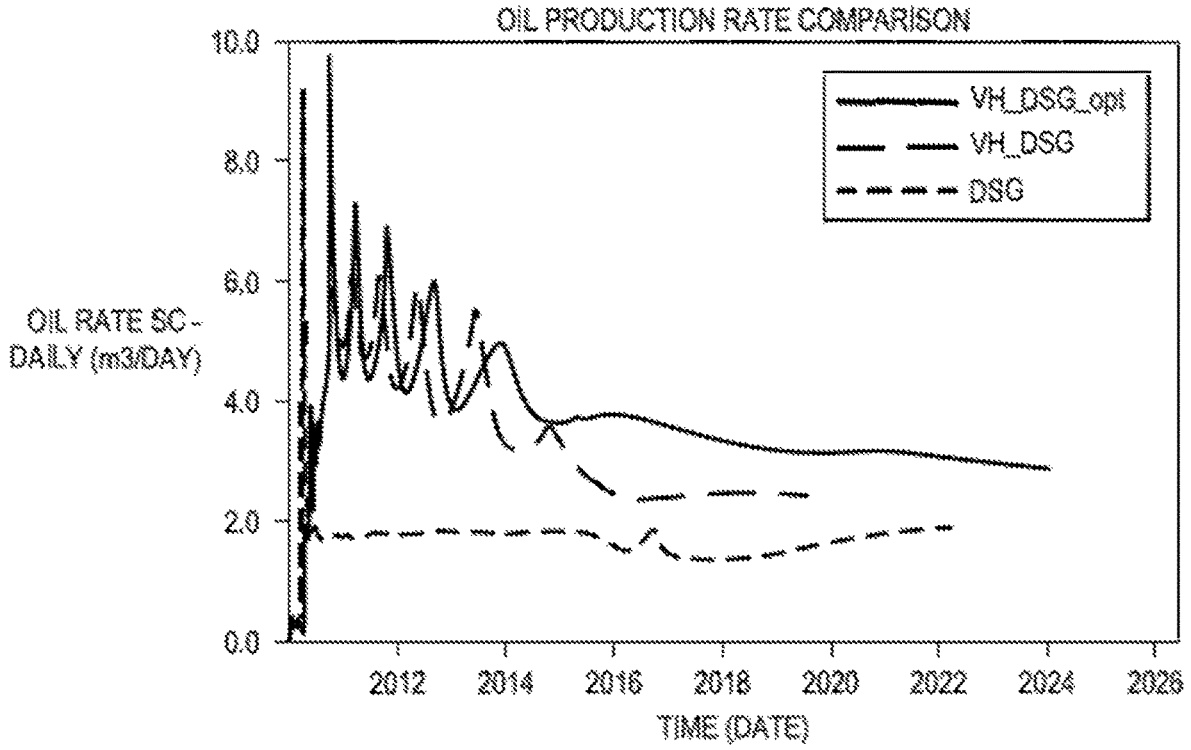
FIG. 11 shows an oil production rate comparison.
Figure 12:
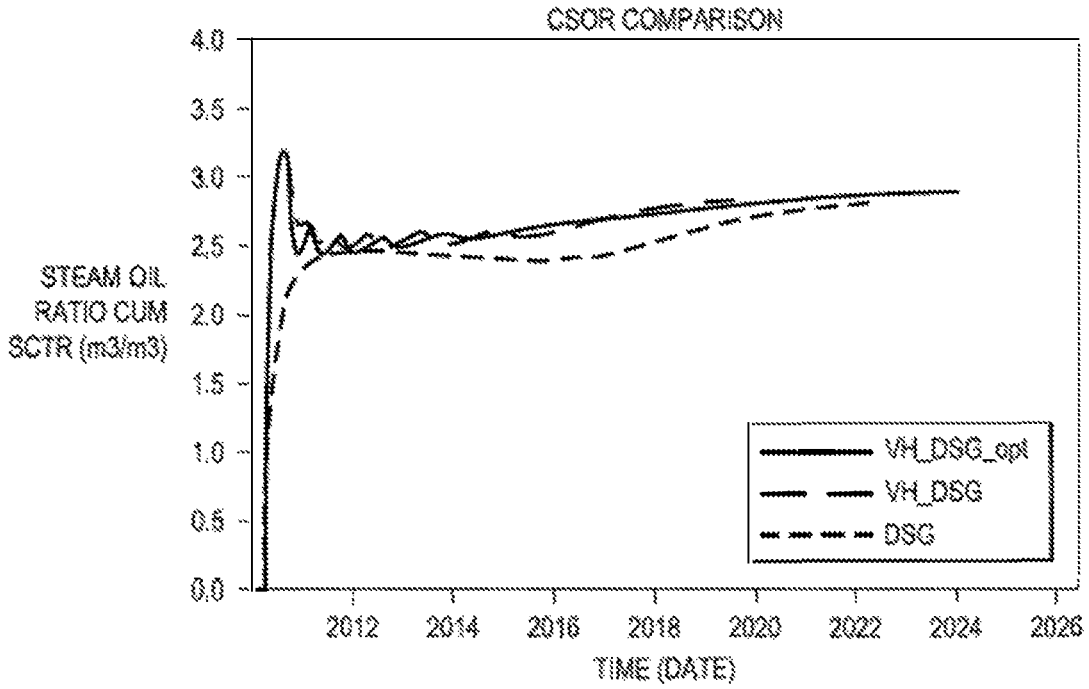
FIG. 12 shows a CSOR comparison.
Figure 13:
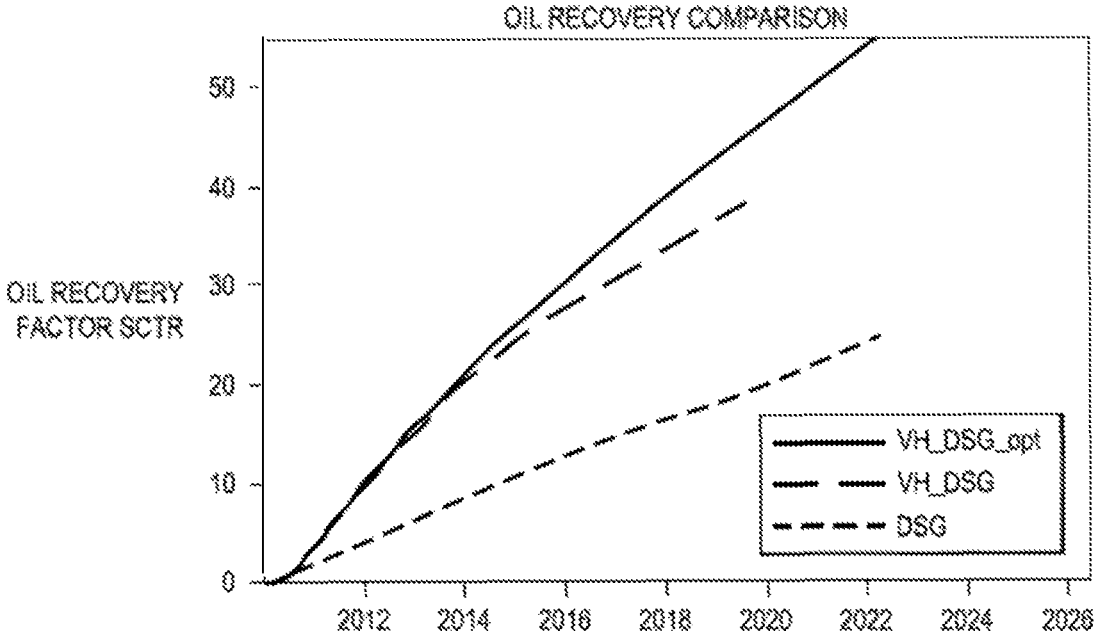
FIG. 13 shows an oil recovery comparison.

FIG. 11 showed oil rate improvement by adjusting the injection and production depths, which resulted in a higher recovery factor. The adjustment did not impact the CSOR, shown in FIG. 12. The acceleration of oil production is mainly attributed to two factors. First, the ability to adjust the injection depth allows greater gas push mechanism that helps oil drainage in addition to gravity. Second, as aforementioned, setting the venting segment/well lower helps pull the steam chamber close to the horizontal well and thus enhancing drainage.

Further optimization parameters include, but are not limited to, the vertical well spacing, injection/production depth in different operation stages, timing of switching roles of vertical injector, and vertical producer, etc.

We have shown in FIG. 5A & FIG. 5B a simple single horizontal well with some number of injectors/produced vertically situated along the horizontal well line but somewhat above it. However, the concept can be applied to any array of horizontal producers, such as arrays of parallel producers; producers with multilateral well branches, as in fishbone arrangements; radial well arrangements, which allow one to take advantage of fewer wellpads; radial fishbone well configurations, and the like.

Figure 14A:
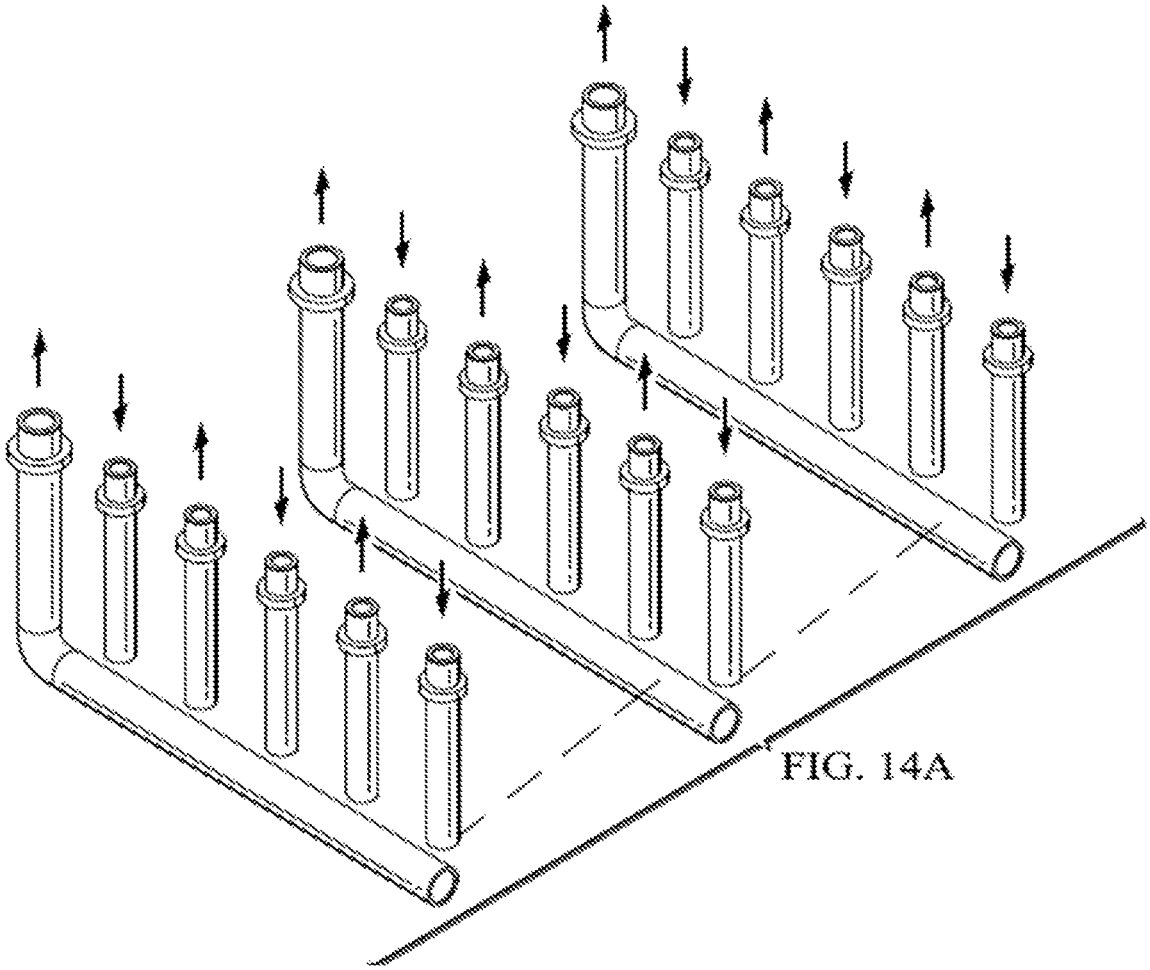
FIG. 14A shows an array of horizontal producers.
Figure 14B:
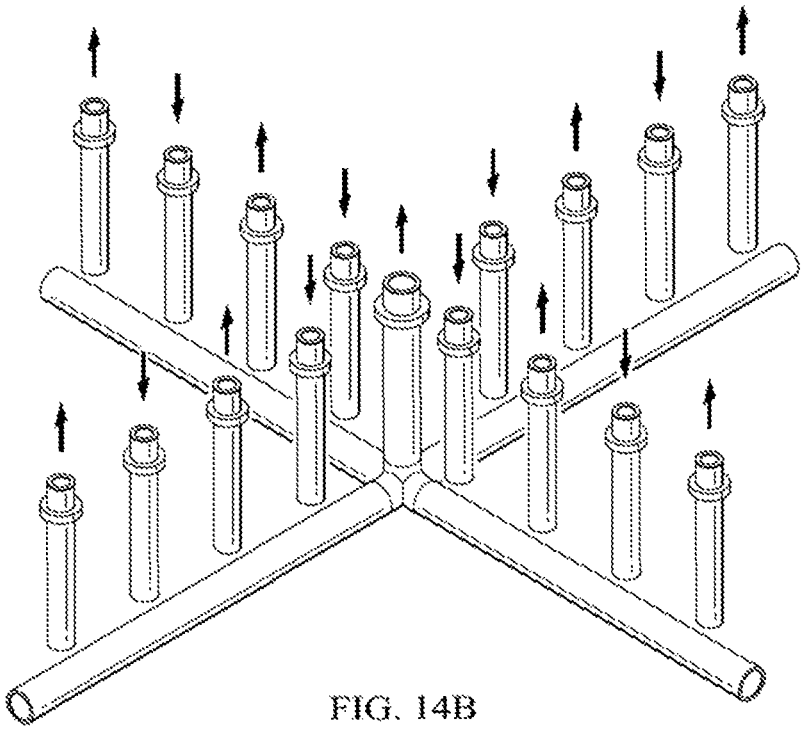
FIG. 14B shows a radial array of horizontal wells.
Figure 14C:
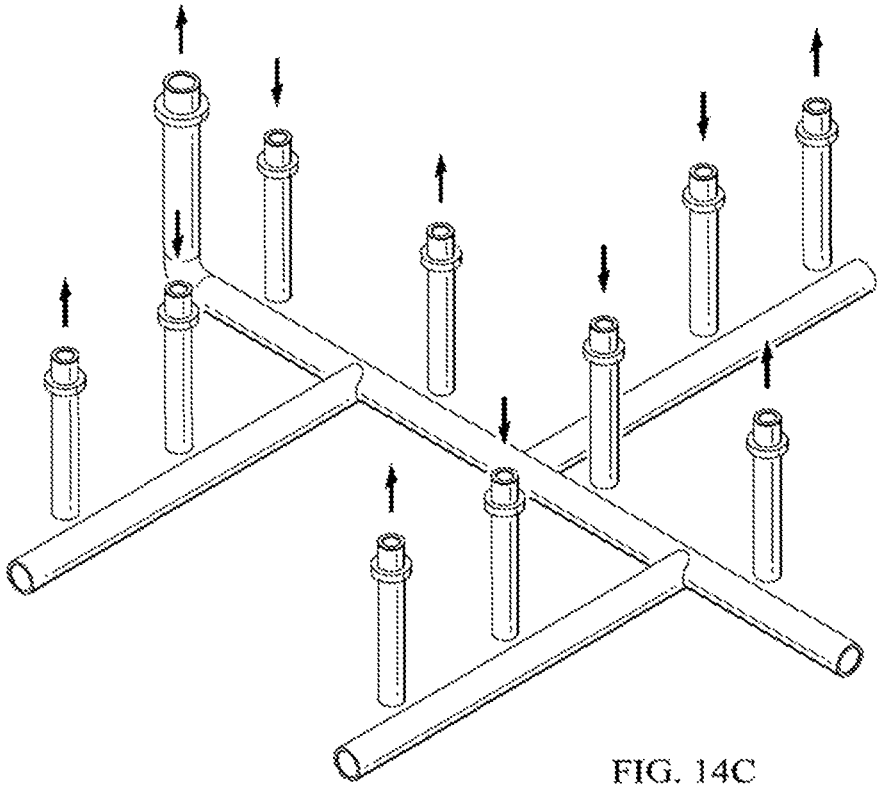
FIG. 14C shows a horizontal well with branches with the base well and branches each having injectors and producers.
Figure 14D:
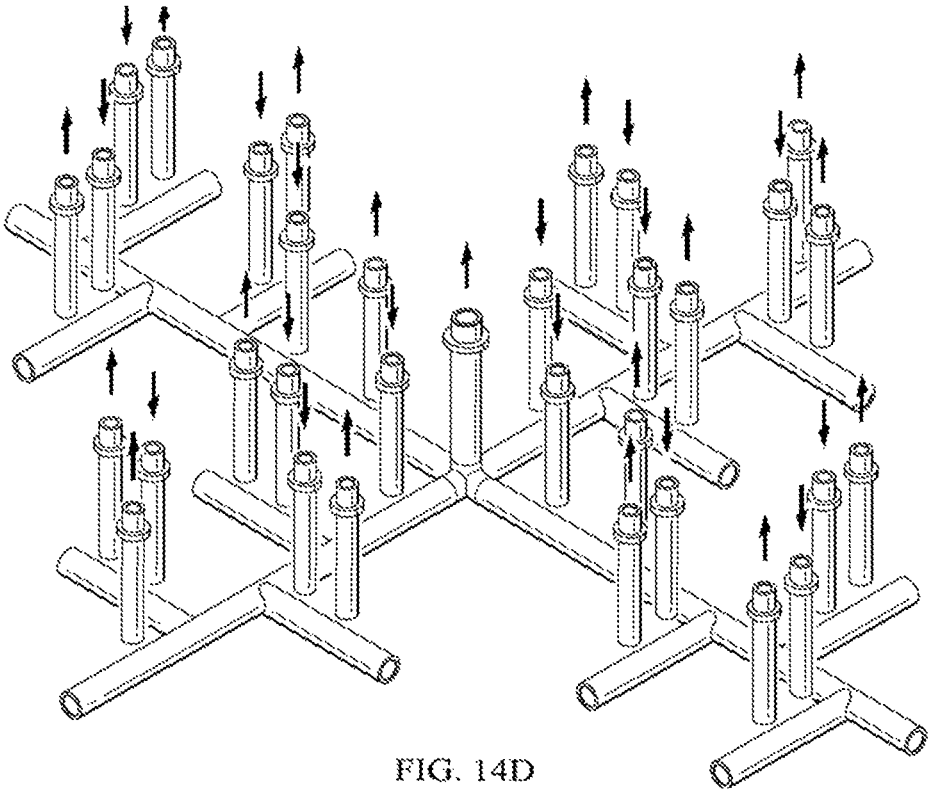
FIG. 14D shows combination radial with branches. Note: wells are not drawn to scale, and right angles are for ease of drawing only.

See e.g., FIG. 14A-D. In FIG. 14A, the vertical producers and vertical injectors over adjacent horizontal wells are staggered. FIG. 14B shows a radial array of horizontal wells, each with vertical injectors/producers. In FIG. 14C a horizontal well with branches, the base well and branches each having injectors and producers, and FIG. 14D combines a radial configuration with branches.

Figure 15:
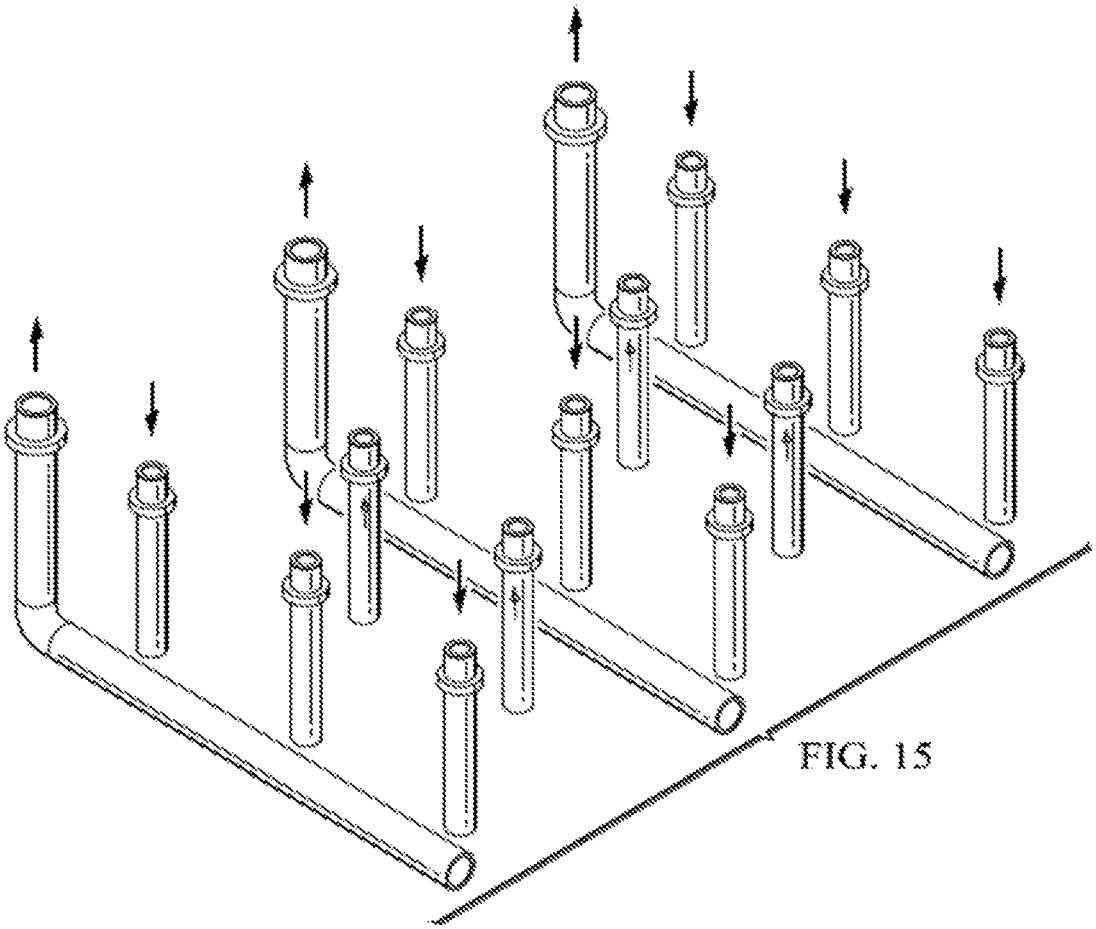
FIG. 15 shows another well configuration wherein vertical producers (or injectors) are offset to sit between a pair of horizontal producers, thus servicing both wells. This arrangement can be applied to any of the configurations in FIG. 14A, FIG. 14B, FIG. 14C, or FIG. 14D.

FIG. 15 shows yet another well configuration wherein vertical producers (or injectors) are laterally offset to sit between a pair of horizontal producers, thus servicing both wells. This arrangement can be applied to any of the configurations in FIG. 14.

In the above simulations, we had both vertical injectors and vertical producers directly over the horizontal producer. However, it may be possible to laterally offset one or the other, especially the vertical producer, and although modeling has not yet been done, we predict that this may improve efficiencies because a single vertical producer can service two horizontal producers. It may be possible to stagger production wells between adjacent rows of horizontal producers, such that one vertical producer well can service two horizontal producers and four injectors (two from each horizontal producer).

In addition, we have exemplified alternating vertical injectors and producers, but this may be variable, depending on the amounts of solvent co-injected into the reservoir, and on the spacing of the wells.

The following are incorporated by reference herein in their entireties for all purposes:

US20100050517
US20110036308
US20110232545
US20120073810
US20120227964
US20130068458
US20130333884
US20140060825
US20140110109
US20140231081
U.S. Pat. No. 4,336,839
U.S. Pat. No. 6,230,814
U.S. Pat. No. 6,591,908
U.S. Pat. No. 7,780,152
U.S. Pat. No. 7,814,867
U.S. Pat. No. 8,079,417
U.S. Pat. No. 8,353,342
U.S. Pat. No. 8,353,343
U.S. Pat. No. 8,602,103
U.S. Pat. No. 8,656,999
Ian D. Gates, Solvent-aided Steam-Assisted Gravity Drainage in thin oil sand reservoirs, J. Petrol. Sci. Engin. 74(3-4):138-146 (2010).
SPE-148698-MS (2011) Betzer, M. M., Steamdrive Direct Contact Steam Generation for SAGD.

We claim:

1. A method of heavy oil production, said method comprising:

a) providing a horizontal production well at a bottom of a heavy oil payzone;

b) providing a plurality of vertical injector wells and a plurality of vertical producer wells along said horizontal production well and terminating directly above said horizontal production well;

c) injecting steam into said injector wells and said vertical producer wells in a start-up period until fluid communication is established;

d) injecting steam and non-condensable solvent (NCS) only into said injector wells to mobilize heavy oil; and e) producing said mobilized heavy oil and condensed steam from said horizontal producer well and simultaneously producing said NCS from said vertical producer wells.

2. The method of claim 1, wherein said steam and said NCS for step d) are produced for said method using a direct steam generator (DSG).

3. The method of claim 1, wherein steam is injected in step d) at a first depth that is higher than a second depth from which said NCS is produced in step e).

4. The method of claim 1, wherein steam is first injected in step d) at a first depth and later in step d) injected at a second depth that is higher than said first depth and higher than a third depth from which said NCS is produced in step e).

5. The method of claim 1, wherein more of said mobilized heavy oil is produced per day than a method using only a horizontal wellpair.

6. The method of claim 1, wherein a said startup period is reduced as compared with a method using only a horizontal wellpair.

7. The method of claim 1, wherein said produced NCS is recycled for use in step d of said method.

8. The method of claim 1, wherein said NCS comprises $N_2$ or $CO_2$.

9. The method of claim 1, wherein said vertical injector wells are fitted with active flow control devices, and wherein steam in step c) is injected at a first depth and in step d) is injected at a second depth that is higher than said first depth and higher than a third depth from which said NCS is produced in step e).

10. A method of heavy oil production, said method comprising:

a. producing steam and $CO_2$ with a direct steam generator (DSG);

b. injecting said steam and said $CO_2$ into a plurality of vertical injection wells, the plurality of vertical injection wells each along and terminating directly above a horizontal producer well;

c. collecting mobilized heavy oil and water from said horizontal production well;

d. collecting said $CO_2$ from a plurality of vertical production wells, the plurality of vertical production wells each along and terminating directly above said horizontal producer well; and e. recycling said collected $CO_2$ in step b.

11. The method of claim 10, wherein said steam is injected at a first depth that is higher than a second depth from which said $CO_2$ is collected produced.

12. The method of claim 10, wherein said steam is first injected at a first depth and later injected at a second depth that is higher than said first depth and higher than a third depth from which said $CO_2$ is collected.

13. The method of claim 10, wherein said vertical injection wells alternate with said vertical production wells.

14. A method of producing heavy oil from a reservoir, said method comprising:

a. providing a horizontal production well at a bottom of a heavy oil payzone, plus a plurality of vertical injector wells and a plurality of vertical producer wells along said horizontal production well and terminating directly above said horizontal production well;

b. injecting steam into said vertical injector wells and said vertical producer wells until fluid communication is established;

c. injecting steam and non-condensable solvent (NCS) into said vertical injector wells to mobilize said heavy oil; and d. producing said mobilized heavy oil and condensed steam from said horizontal producer well and simultaneously producing said NCS from said vertical producer wells.

15. The method of claim 14, wherein said NCS is $N_2$ or $CO_2$.

16. The method of claim 14, wherein said vertical injector wells are fitted with active flow control devices, and wherein said steam in step b) is injected at a first depth and is injected in step c) at a second depth that is higher than said first depth and higher than a third depth from which said NCS is produced in step d).

17. The method of claim 14, wherein said NCS from step d) is recycled for use in step c) of said method.

18. An improved method of heavy oil production using a direct steam generator (DSG), said method comprising injecting steam and $CO_2$ from said a DSG into a horizontal injection well of a horizontal wellpair and collecting mobilized heavy oil, $CO_2$ and water from a horizontal production well of said horizontal wellpair, the improvement comprising:

injecting said steam and said $CO_2$ from said DSG into a plurality of vertical injection wells, the plurality of vertical injection wells each along and terminating directly above a horizontal producer well, collecting mobilized heavy oil and water from said horizontal producer well, and collecting said $CO_2$ from a plurality of vertical production wells, the plurality of vertical production wells each along and terminating directly above said horizontal producer well, wherein the vertical injection wells alternate with the vertical production wells, and wherein more of said mobilized heavy oil is produced per day than a method using only said horizontal wellpair.

19. The method of claim 18, wherein said steam is injected at a first depth that is higher than a second depth from which said $CO_2$ is collected.

20. The method of claim 18, wherein said steam is first injected at a first depth and later injected at a second depth that is higher than said first depth and higher than a third depth from which said $CO_2$ is collected.

* * * * *